United States Patent [19]

Theurer et al.

[11] Patent Number: 4,644,868

[45] Date of Patent: Feb. 24, 1987

[54] CONTINUOUSLY ADVANCING TRACK LEVELING, LINING AND TAMPING MACHINE

[75] Inventors: Josef Theurer, Vienna; Johann Hansmann, Klosterneuburg, both of Austria

[73] Assignee: Franz Plasser Bahnbaumaschinen-Industriegesellschaft m.b.H, Vienna, Austria

[21] Appl. No.: 672,119

[22] Filed: Nov. 16, 1984

[30] Foreign Application Priority Data

Jun. 1, 1984 [AT] Austria ..... 1817/84

[51] Int. Cl.[4] ..... E01B 27/17

[52] U.S. Cl. ..... 104/7.2; 104/12

[58] Field of Search ..... 104/2, 7 R, 7 B, 12

[56] References Cited

U.S. PATENT DOCUMENTS

| | | | |
|---|---|---|---|
| 3,494,297 | 2/1970 | Plasser et al. | 104/7 B |
| 3,795,198 | 3/1974 | Plasser et al. | 104/12 |
| 3,832,952 | 9/1974 | Hurni | 104/7 B |
| 4,248,154 | 2/1981 | Theurer | 104/7 B |
| 4,399,753 | 8/1983 | Theurer et al. | 104/7 B |
| 4,534,295 | 8/1985 | Theurer | 104/7 B |

FOREIGN PATENT DOCUMENTS

| | | |
|---|---|---|
| 2126634 | 3/1984 | United Kingdom . |
| 2126635 | 3/1984 | United Kingdom . |

*Primary Examiner*—Randolph A. Reese
*Attorney, Agent, or Firm*—Kurt Kelman

[57] ABSTRACT

A continuously advancing track leveling, lining and tamping machine comprises a heavy main frame supported on two spaced apart undercarriages for continuous movement in an operating direction and a power plant, drives and operating controls as well as an operator's cab for operating the drives and controls mounted on the main frame. Two separate carrier frames are arranged between the two undercarriages of the heavy main frame, and a drive connected to the heavy main frame longitudinally displaces the carrier frames in relation to the main frame whereby the carrier frames may be intermittently advanced during the continuous movement of the heavy main frame, this drive having a displacement path corresponding to a distance between at least two successive ties. One of the separate carrier frames supports tools for tamping ballast in intermittent tamping cycles under respective ones of the ties at points of intersection of the two rails and the respective ties, and a track lofting and lining unit is mounted on the other one of the separate carrier frames. The tamping tools and the lifting and lining unit is arranged within sight of the operator's cab, and the power plant delivers power to, and the operating controls control, the tamping, track lifting and lining. Track leveling and lining reference systems are associated with the track lifting and lining unit.

21 Claims, 6 Drawing Figures

CONTINUOUSLY ADVANCING TRACK LEVELING, LINING AND TAMPING MACHINE

The present invention relates to a continuously advancing machine for leveling, lining and tamping a track consisting of two rails fastened to successive ties resting on ballast, and more particularly to such a machine which comprises a heavy main frame supported on two spaced apart undercarriages for continuous movement in an operating direction, a power plant, drive means and operating control means as well as an operator's cab for operating the drive and control means mounted on the main frame, carrier frame means arranged between the two undercarriages of the heavy main frame, another drive means connected to the heavy main frame for longitudinally displacing the carrier frame means in relation to the main frame whereby the carrier frame means may be intermittently advanced during the continuous movement of the heavy main frame, the other drive means having a displacement path corresponding to a distance between at least two successive ties, tamping means for tamping ballast in intermittent tamping cycles under respective ones of the ties at points of intersection of the two rails and the respective ties, and track lifting and lining means mounted on the carrier frame means, the tamping, lifting and lining means being arranged within sight of the operator's cab, and the power plant delivering power to, and the operating control means controlling, the tamping, track lifting and lining means, and track leveling and lining reference systems associated with the track lifting and lining means.

A non-stop operating track leveling, lining and tamping machine of this type has been disclosed in copending U.S. patent application Ser. No. 609,026, filed May 10, 1984, which is a continuation-in-part of copending U.S. Pat. No. 4,596,193 filed May 26, 1983, as well as copending U.S. Pat. No. 4,534,295 filed May 26, 1983, which are counterparts of British patent applications Nos. 2,126,634 A and 2,126,635 A, both published Mar. 28, 1984. This machine has been used with great success and has opened new development possibilities over the standard track leveling, lining and tamping machines which advance intermittently along the track. The track tamping, lifting and lining tools are mounted on a single subframe to form an operating unit which is displaced intermittently while the heavy main frame advances continuously. The subframe may take the form of a carriage with a forwardly projecting pole means, as has also been disclosed in U.S. Pat. No. 4,399,753, dated Aug. 23, 1983, the pole means being linked to the main frame by a power-actuated drive. The new tamping concept disclosed therein has for the first time made it feasible to tamp track in an assembly-line fashion, i.e. to advance the machine continuously while cyclically tamping the ballast under the leveled and lined track. In a machine incorporating this concept, a considerable part of the operating forces generated by the track tamping, lifting and lining tools are transmitted to the track through an undercarriage supporting the subframe on the track, thus subjecting the main frame to much less static and dynamic stress than in the standard tampers. Furthermore, since most operational impacts and vibrations occurring during tamping, leveling and lining are kept away from the operator's cab on the heavy main frame, the operators work under considerably improved conditions. Also, since only the much lighter subframe, which constitutes no more than about 25% of the weight of the machine, is cyclically accelerated and stopped, much less power is required for the operation of the machine, the comfort of the operating crew in the cab is further enhanced, and the drive and brake means for the main frame are subjected to much less wear.

U.S. Pat. No. 3,795,198, dated Mar. 5, 1974, discloses a non-stop advancing track leveling, lining and tamping machine in which the tamping head is moved relative to the continuously advancing machine frame in synchronization with the machine advance in such a manner that the tamping tools are held in respective cribs while they tamp the ballast. A track position correction unit is stationarily mounted on the machine frame at a relatively long distance from the tamping head. In one embodiment, the machine comprises an elongated subframe longitudinally displaceably carried by the machine frame and carrying four tamping tools, i.e. two surface ballast compactors and two single pivotal tamping tools. The subframe further carries a track lifting and lining device for each rail. The longitudinal displacement path for the tamping tools is relatively short, which makes the advancement speed of such a machine so low as to make it too inefficient for commercial use. Also, mounting the track correction tools stationary while the tamping tools are longitudinally moved changes the curvature of the rails between the tamping and track correction points, which is disadvantageous. A machine of this type has not been manufactured.

U.S. Pat. No. 3,832,952, dated Sept. 3, 1974, discloses a standard intermittently advancing track leveling, lining and tamping machine, wherein the carrier frames for the tamping tools and for the track lifting and lining unit are connected to the machine frame by drives enabling the carrier frames to be slightly displaced longitudinally for proper centering. The displacement paths are very small so that a non-stop advance of the machine frame during the tamping cycles is not possible. Similar considerations hold for U.S. Pat. No. 4,248,154, dated Feb. 3, 1981, wherein the carrier frame for the track lifting and lining unit is slightly displaceable for properly positioning the unit.

It is the primary object of this invention to provide a commercially effective continuously advancing track leveling, lining and tamping machine with all the advantages first described hereinabove while enabling the operating tools to be coordinated individually in a more effective manner.

The above and other objects are accomplished according to the invention in this type of non-stop operating track leveling, lining and tamping machine with carrier frame means consisting of two separate carrier frames arranged between the two undercarriages of the heavy machine frame, the tamping means being mounted on one of the separate carrier frames while the track lifting and lining means is mounted on the other one of the separate carrier frames. The carrier frames may be longitudinally displaceable synchronously and together or independently by the other drive means.

In such a machine, the one carrier frame on which the tamping means is mounted is further relieved, this requiring even less power for acceleration and braking so that the cyclic movement of the tamping means carrier frame may be effected more rapidly. More particularly, since the lining and lifting forces are partially or fully transmitted to the heavy main frame, they do not unfavorably affect the tamping means carrier frame which is correspondingly relieved of these forces. This is of particular advantage when working on relatively heavy track switch sections. Furthermore, this construction enables the longitudinal distance of the lifting and lining tools from the tamping tools and the leveling and lining sensors to be individually adjusted, for example for tracks of different gauges or for different flexing curvatures of the track rails whereby the machine may be readily adapted to prevailing operating conditions. All of these advantages are achieved without impairing any of the advantages obtained with the first-described non-stop tamper.

The above and other objects, advantages and features of the present invention will become more apparent from the following detailed description of certain now preferred embodiments thereof, taken in conjunction with the accompanying, somewhat schematic drawing wherein FIG. 1 shows a side elevational view of a universal, non-stop track leveling, lining and tamping machine adapted for use in tangent track and in switches;

Figure 1:
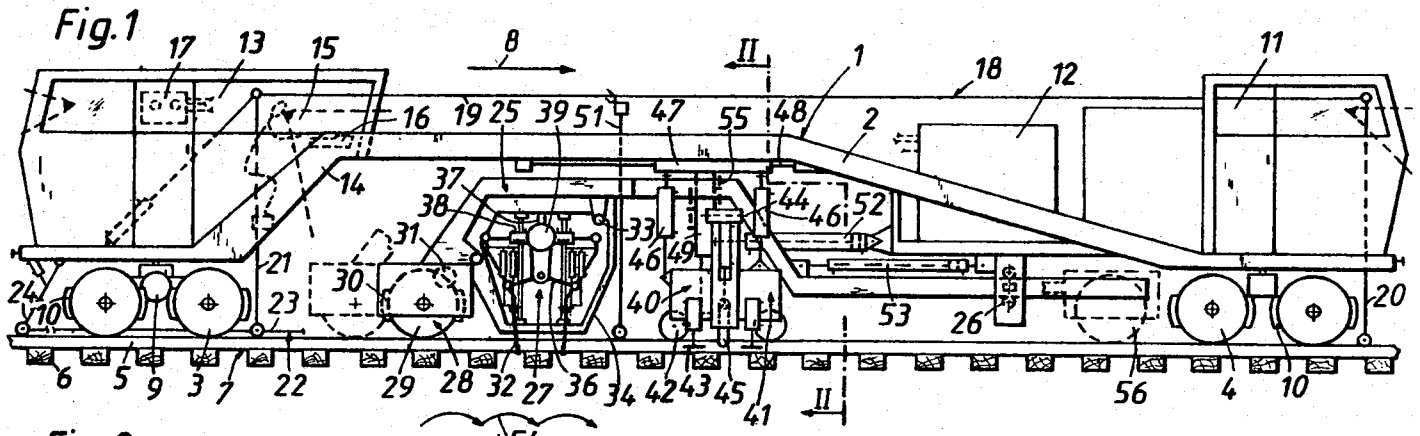
Figure 3:
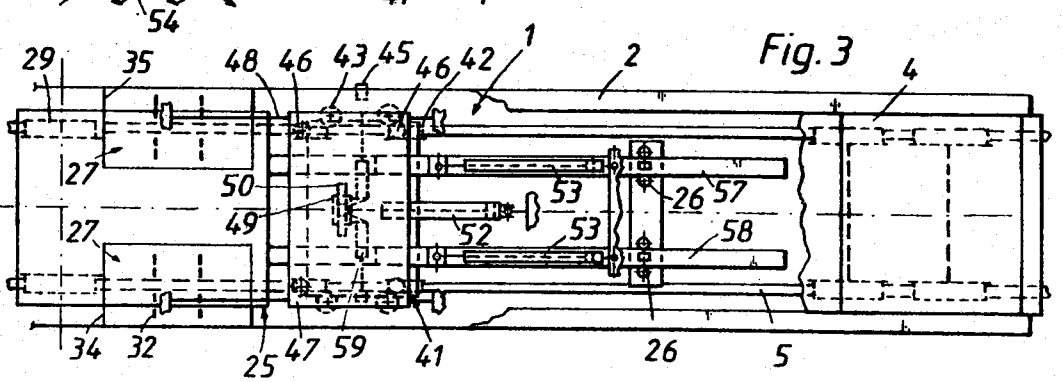
FIG. 3 is a diagrammatic plan view of the machine of FIG. 1.
Figure 2:
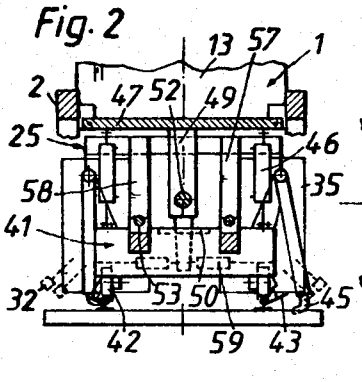
FIG. 2 shows a transverse section of the machine along line II—II of FIG. 1.

Referring now to the drawing and first to FIGS. 1 to 3, there is shown continuously advancing machine 1 for leveling, lining and tamping track 7 consisting of two rails 5 fastened to successive ties 6 resting on ballast (not shown). The track may be a heavy switch section. The machine comprises heavy main frame 2 supported on two spaced apart undercarriages illustrated as swivel trucks 3, 4 for continuous movement in an operating direction indicated by arrow 8. Power plant 12, drive means 9 and central operating control means 17 as well as operator's cabs 11 and 13 for operating the drive and control means are mounted on main frame 2. The diagrammatically illustrated drive means 9 receives power from power plant 12 and transmits a driving force to the wheels of rear swivel truck 3 to advance the machine in the operating direction, pneumatically operated brake means 10 being provided for stopping the machine. An operator in front cab 11 controls the drive and brakes for main frame 2 while an operator in rear cab 13 sits behind a large window at control panel 16 within sight of the track tamping, lifting and lining means. Operator's cab 13 is mounted between two longitudinal beams 14 of heavy main frame 2, and power plant 12 delivers power to, and operating control means 17 controls, the tamping, track lifting and lining means to be described hereinafter.

In a conventional manner, machine 1 also comprises track leveling and lining reference systems 18 and 22 associated with the track lifting and lining means. Leveling reference system 18 comprises a respective tensioned wire 19 associated with each rail 5, rail sensing element 20 supporting the front ends of the tensioned reference wires on an uncorrected track section while rail sensing element 21 supports the rear ends of wires 19 on the corrected track section. Lining reference system 22 comprises tensioned wire 23 extending centrally between rails 5 from front rail sensing element 20 through rear rail sensing element 21 to further rail sensing element 24.

According to this invention, two separate carrier frames 25 and 41 are arranged between undercarriages 3 and 4 of heavy main frame 2. Tamping means 27 is mounted on separate carrier frame 25 for tamping ballast in intermittent tamping cycles under respective ties 6 at points of intersection of the two rails 5 and the respective tie, and track lifting and lining means 45, 43 is mounted on separate carrier frame 41. Another drive means 52, 53 is connected to heavy main frame 2 for longitudinally displacing carrier frames 25 and 41 in relation to main frame 2 whereby the carrier frames may be intermittently advanced during the continuous movement of the heavy main frame. Drive means 52, 53 has a displacement path corresponding to a distance between at least two successive ties.

Carrier frame 25 has the form of a carriage with pole means 57, 58 projecting forwardly from the carriage in the operating direction, the illustrated pole means consisting of two longitudinal beams. The other drive means comprises hydraulically operated cylinder-piston drives 53 linking pole means beams 57, 58 to heavy frame 2 for universal movement of carrier frame 25 in relation to heavy frame 2, roller bearings 26 mounting the front ends of the pole means beams on the heavy main frame for universal movement and longitudinal adjustment in relation to the main frame. Carriage frame 41 is longitudinally adjustably mounted on the main frame by means of sliding carriage 47 longitudinally displaceably mounted in a longitudinal guide bearing consisting of guide rod 48 on main frame 2, track lifting drive means 46 linking carrier frame 41 to sliding carriage 47 and vertically adjusting carrier frame 41 in relation to main frame 2 and carrier frame 25, and the other drive means further comprising separate hydraulically operated cylinder-piston drive 52 connected to sliding carriage 47. As shown, the cylinder of drive 52 is linked to main frame 2 and the piston thereof is linked to the sliding carriage. A pair of flanged wheels 28 provides gear 29 supporting and guiding a rear end, in the operating direction, of the carriage of carrier frame 25 on track rails 5, tamping means 27 being mounted on the carriage immediately adjacent the pair of flanged wheels 28 forwardly thereof, in the operating direction. Pairs of flanged wheels 42 guide and support carrier frame 41 on track rails 5. Carrier frame supporting and guiding gear 29 supports and guides carrier frame 25 on the track during its intermittent working movements as well as when machine 1 is driven from one working site to another. It is equipped with its own drive 31 and brake means 30 so that it may be driven and stopped independently.

Tamping means 27 is preferably constructed for universal use in tangent track and switches, such as disclosed, for example, in copending U.S. Pat. No. 4,537,135, filed Jan. 30, 1984. It comprises respective tamping head 34, 35 associated with each track rail 5, each tamping head comprising vertically adjustable tamping tool carrier 36 and two pairs of power-driven, reciprocable and vibratory tamping tools 32 mounted on each tamping tool carrier, each tamping tool being independently laterally pivotal. The tamping heads are transversely displaceable by drive means 33. The tamping tool carriers are vertically adjustable by drives 37 and the pairs of tamping tools are reciprocable by drives 38 and vibrated by drives 39. The track lifting and lining means comprises track lifting and lining unit 40 preceding tamping means 27, in the operating direction, the track lifting and lining unit comprising track lifting and lining tools 43 and 45 for engagement with the track rails and drives 46 and 59 for vertically and laterally moving the tools for leveling and lining. Carrier frame 41 is a common frame whereon the track lifting and lining means associated with both track rails 5 are mounted, drive 52 linking the common frame to the main frame. The illustrated track lifting and lining means is arranged for operation in a switch according to U.S. Pat. No. 4,248,154, the lifting tools comprising pairs of laterally pivotal rail gripping rollers 43 associated with each rail 5 and a rectilinearly displaceable rail gripping hook 45 centered between the rollers of each pair and pivotal at its upper end about axis 44 extending in the operating direction. The cylinders of hydraulically operated cylinder-piston lifting drives 46 are universally linked to sliding carriage 47 and two parallel guide rods 48 affixed to main frame 2 carry the sliding carriage for displacement in the operating direction. Entrainment element 49 projects downwardly from sliding carriage 47 into slot 50 in carrier frame 41. The slot has at least double the length of the width of the entrainment element so that the carrier frame may move transversely with respect to main frame 2 to position itself conformingly to a curving track. Since entrainment element 49 freely moves vertically in slot 50, the carrier frame may also move vertically with respect thereto.

Rail sensing element 51 cooperates with leveling reference wire 19 between tamping means 27 and carrier frame 41. This rail sensing element is designed to monitor the track level and is vertically movably mounted on carrier frame 25 for movement therewith. Alternatively, the track level sensing element may be vertically movably mounted on carrier frame 41.

Separate hydraulically operated cylinder-piston drives 52 and 53 connect carrier frame 41 and 25 to main frame 2. The cylinders of the longitudinal carrier frame displacement drives are universally linked to the main frame. The piston rod of drive 52 is linked to entrainment element 49 while the piston rods of drives 53 are linked to carrier frame 25. To enable carrier frames 25 and 41 to be intermittently displaced from one tie 6 to the next succeeding tie 6 while main frame advances continuously in the operating direction, the displacement path of drives 52 and 53 is at least twice the distance between the ties. The distance between undercarriage 29 and track lifting and lining unit 40 spans only about five to six successive ties. Operating control means 17 comprises valve means controlling the piston movements of double-acting drives 52 and 53 synchronously with the advancing movement of heavy main frame 2 but in an opposite direction thereto. Small arrows 54 indicate the intermittent movement of carrier frames 25 and 41 from one tamping point to the next.

The separate longitudinally displaceable mounting of the two separate carrier frames on the heavy main frame and their separate support and guidance on the track rails by pairs of flanged wheels assures the dependable and automatic steering of the two separate carrier frames along the track to make certain that the operating tools are always properly centered while the main frame is relieved of their weight. The independent longitudinal displacement of the two carrier frames by separate drives makes it possible to take into account different operating conditions and to adjust the distance between the tamping means and the track lifting and lining means in accordance with local requirements, for example. Whether the carrier frames are longitudinally displaced together or independently, the advantage of the machine operating non-stop remains. The provision of separate drives makes it possible to adjust the relative positions of the tamping means and the track lifting and lining means by remote control in difficult track sections, such as switches. The above described carrier frame combination illustrated in FIGS. 1 to 3 combines the advantages of the automatic steering of the trailing tamping means carrier frame with its relief from the weight of the track lifting and lining means which is mounted on a separate carrier frame. By mounting the latter carrier frame on a longitudinally displaceable sliding carriage on the main frame, the lifting and lining forces will be transmitted to the continuously advancing main frame. This carrier frame will be properly longitudinally displaced relative to the main frame independently of the tamping means carrier frame with the drive ends respectively linked to the main frame and the sliding carriage, thus further relieving the tamping means carrier frame from any influence by the track lifting and lining means carrier frame. The use of the specific tamping means described hereinabove and illustrated in FIGS. 1 to 3 further enhances the efficiency and quality of the operation of this non-stop machine. The provision of the independent drive and brake means for the tamping means carrier frame reduces the stress on the main frame and its drive and brake means, enhances the operating safety and further increases the comfort of the operating crew traveling on the main frame. The use of transversely displaceable tamping heads associated with each rail is of particular value in switch tampers since this facilitates the proper lateral positioning of the tamping tools in switches. At the same time, the common frame for the track lifting and lining unit for both rails produces a robust operating unit. The disclosed distances of the displacement path and of the track lifting and lining unit from the tamping means assures that the non-stop advance of the main frame need not be interrupted even when a tamping stage takes longer than usual and also makes it possible to vary the distances between the carrier frames according to prevailing operating conditions. The synchronization of the hydraulic longitudinal displacement drives makes certain that the two carrier frames will stand still during a tamping cycle while the main machine frame advances non-stop.

As shown in FIG. 1, the machine further comprises coupling means 55 connecting carrier frames 25 and 41 for common and intermittent longitudinal displacement, drives 53 connecting the one carrier frame 25 to main frame 2 and other carrier frame 41 being longitudinally adjustably mounted on the main frame. The illustrated coupling means is adjustable in the direction of the track, being a manually or motor driven slide, clamp or gear connection. This arrangement enables the distance between the working tools on the two carrier frames to be set according to prevailing operating conditions, whereupon the two coupled carrier frames may be longitudinally displaced by a single drive.

As indicated in broken lines in FIG. 1, carrier frame 25 may be modified to be an elongated auxiliary frame whose rear end is supported and guided on track 7 by gear 29 while its front end is supported on the track by undercarriage 56 instead of being mounted on the main frame by roller bearing 26. As is apparent from FIGS. 2 and 3, the pole means of carrier frame 25 is comprised of two parallel beams 57, 58 each of which is longitudinally guided in roller bearing 26 on main frame 2 and is connected to drive 53. The means for lining track 7 comprises two lining drives 59 which are universally linked, on the one hand, to the lower end of entrainment element 49 mounted on sliding carriage 47 and, on the other hand, to carrier frame 41. Tamping tools 32 of tamping means 27 are shown in broken lines in a laterally pivoted position so that those tamping tools which do not encounter any obstacles may be immersed into the ballast without hindrance from those tools whose immersion may be prevented by such obstacles. In the illustrated position, the distance of supporting and guiding gear 29 from the inner axle of swivel truck 3 is about 2.5 m while its distance from front swivel truck 4 is about 9 m.

The operation of machine 1 will partly be obvious from the above description of its structure and will now be explained in detail.

At the start of the operation, drives 53 are actuated to advance carrier frame 25 to a position wherein tamping means 27 are centered over a tie 6 to be tamped. Subsequently, drive 52 is actuated to displace carrier frame 41 so that it has the desired distance from tamping means 27, whereupon coupling means 55 is operated to couple the two carrier frames together for common displacement. The operator at control panel 16 now actuates vibrating drive 39 and lowers tamping means 27 to immerse the tamping tools in the ballast and to start the tamping operation. Simultaneously, the operator at control panel 16 disengages brake means 10 and actuates forward drive 9 to advance main frame 2 of machine 1 non-stop in the operating direction indicated by arrow 8. During the tamping operation, coupled carrier frames 25 and 41 remain stationary. After the ballast has been tamped under tie 6 to attain a desired density, tamping means 27 are raised to lift the tamping tools out of the ballast and drives 53 are actuated for rapid displacement of the carrier frames to the next succeeding tamping station. During this displacement, no pressure is applied to drive 52. Alternatively, the intermittent displacement of the two carrier frames may be effected by drive 31 for wheels 28 which support and guide the rear of carrier frame 25 on the track. Track lifting and lining unit 40 is operated in the conventional manner, lifting rollers 43 or lifting hook 45 being selectively used, as is well known.

Alternatively, coupling means 55 may be detached and the two carrier frames may be displaced independently of each other by actuation of drives 52 and 53. In this mode of operation, it will be advantageous to actuate the drives synchronously. In this operation, it is possible to use drive 52 for the very accurate distancing of the two carrier frames to obtain a desired spacing between tamping means 27 and track lifting and lining unit 40 at each tamping station and while the machine continues to operate non-stop. In any event, the lifting forces, which are particularly large in track switches, are transferred to the heavy main frame and not to the carrier frame for the tamping means.

Figure 4:
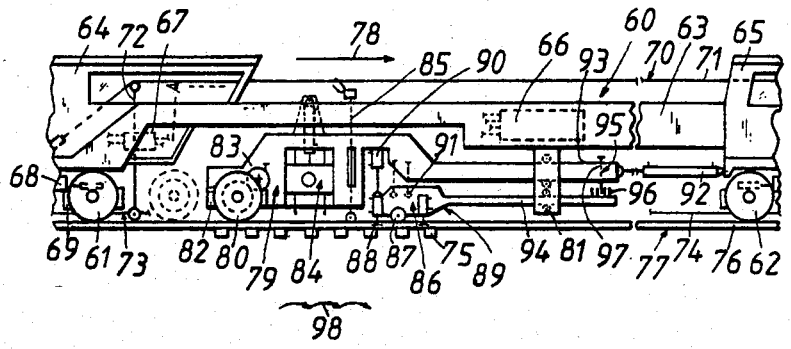
FIG. 4 is a side elevational view of another embodiment of a non-stop track leveling, lining and tamping machine for work in tangent track.

FIG. 4 illustrates continuously advancing production tamping machine 60 for leveling, lining and tamping tangent track 77 comprised of rails 76 fastened to ties 75. The machine comprises heavy main frame 63 supported on two spaced apart swivel trucks 61, 62 for continuous movement in an operating direction indicated by arrow 78. Power plant 66 is mounted on the front portion of the main frame and operator's cabs 64 and 65 are respectively mounted at the rear and front ends of the main frame. Operating control means 67 for operating the machine drive and the working tools are mounted on cab 64, and flexible power transmission lines lead therefrom to the drives of the tamping, lifting and lining means. Each swivel truck 61, 62 is equipped with drives 68 and brake means 69 operating on the wheels of the trucks. Leveling reference system 70 comprises two tensioned wires 71 whose rear ends are supported by track sensing element 72 on the corrected track section while their front ends, as in the embodiment of FIG. 1, are supported on the track section to be corrected. Machine 60 is also equipped with lining reference system 71 comprising tensioned wire 74 extending centrally between the track rails from a front track sensing element to rear track sensing element 72.

Carrier frame 79 for tamping means 84 is arranged between swivel trucks 61, 62 and is an elongated subframe having a front and a rear end, in the operating direction. The subframe has the form of a carriage with pole means 93 projecting forwardly from the carriage in the operating direction. The rear end of carrier frame 79 is supported and guided on track rails 76 by freely movable steering gear 80 while the pole means is guided in roller bearing 81 mounted on heavy main frame 63. The steering gear is equipped with its own brake and drive means 82, 83. Vertically adjustable tamping means 84 with reciprocable and vibratory tamping tools is mounted on carrier frame 79 immediately in front of steering gear 80. The level of track 77 is sensed by track sensing element 85 which carries a rotary potentiometer cooperating with reference wire 71 to emit a track leveling control signal. Carrier frame 86 for the track lifting and lining means 89 also has the form of a carriage with pole means 94 projecting forwardly from the carriage in the operating direction, the pole means of carrier frame 86 being linked to heavy frame 63 for universal movement in relation thereto in roller bearing 81. The rear end of carrier frame 86 is supported and guided on track 77 by a pair of flanged wheels 87. The flanged wheels are centered between pairs of laterally pivotal track lifting and lining rollers 88 engaging each rail. Track lifting drive means 90 link the rear end of the carriage of carrier frame 86 to the carriage of carrier frame 79. For lining of track 77, two lining drives 91 are linked, respectively, to carrier frames 79 and 86. Hydraulically operated cylinder-piston drive 92 links the pole means of carrier frame 79 to heavy frame 63 for universal movement of the carrier frame in relation to the heavy frame and for common longitudinal displacement of carrier frames 79 and 86 in relation to main frame 63 whereby the carrier frames may be intermittently advanced during the continuous movement of the heavy main frame. The cylinder end of drive 92 is linked to the main frame while the piston is linked to carrier frame 79. By providing common hydraulically operated cylinder-piston drive 92 connecting carrier frames 79 and 86 to main frame 63, all the advantages of the non-stop operating machine with an automatic guidance of the tamping means carrier frame and a separate carrier frame supporting the track lifting and lining means are retained while the drive control for the carrier frames is greatly simplified.

Coupling means 95 interconnects the pole means of carrier frames 75 and 86 at front ends thereof, in the operating direction. The illustrated coupling means is comprised of plates 96 affixed to carrier frame 86 and extending in a direction transverse to the direction of elongation of the machine and bolt 97 inserted in a vertical bore in carrier frame 79 for engagement between the plates.

In the illustrated position, the distance between the axle of rear undercarriage 61 and steering gear 80 of carrier frame 79 is about 2.5 m while the distance between the steering gear and the axle of front undercarriage 62 is about 10 m. Small arrows 98 symbolically indicate the intermittent advancement of carrier frames 79 and 86 between successive tamping cycles while arrow 78 indicates the continuous advance of the heavy main frame. Since the coupling means 95 may be temporarily disconnected, the two carrier frames may be suitably repositioned in relation to each other to adjust to different operating conditions. Since carrier frame 86 for the track lifting and lining means is supported on the heavy main frame by roller bearing 81, at least a portion of the lifting and lining forces is transmitted to the main frame and the carrier frame for the tamping means is relieved of these forces.

The embodiment of FIG. 4 enables the following non-stop production tamping operation to be executed with machine 60:

Common displacement drive 92 for carrier frames 79 and 96 is actuated at the start of the operation to bring the carrier frames into a forward position wherein tamping means 84 is centered over a tie 75 under which ballast is to be tamped. The operator in cab 64 then operates control means 67 to immerse tamping means 84 in the ballast and to reciprocate the vibratory tamping tools. At the same time, drive 68 is actuated to start advancing main frame 63 of machine 60 continuously. During the tamping cycle, carrier frames 79 and 86 remain stationary. After tamping as well as track leveling and/or lining have been completed, drive 92 is actuated in the opposite direction to displace the two carrier frames longitudinally forwardly into their forward position centered over the next tie to be tamped. During the intermittent movement, coupling means 95 interconnects the two carrier frames for common displacement. If it is desired to change the distance on the track lifting and lining means from tamping means 84, it is only necessary to lift bolt 97 to disconnect the two carrier frames, and carrier frame 86 may then be manually moved until the desired distance is obtained. The two carrier frames are then coupled together again for common displacement by drive 92, bolt 97 being simply lowered for engagement in the channel between the two plates 96.

Figure 5:
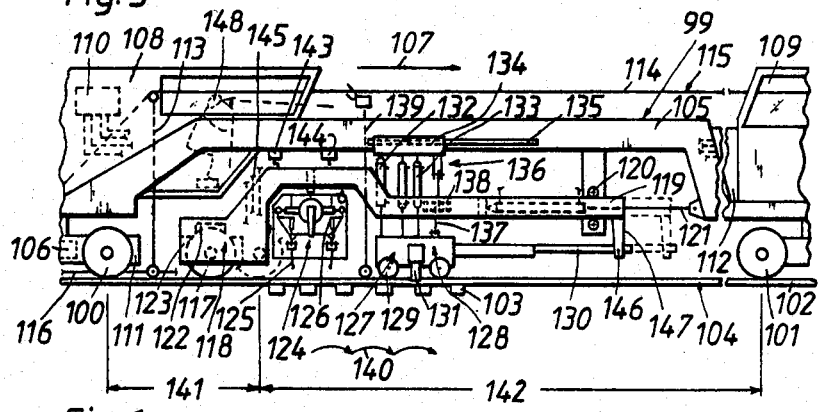
FIG. 5 is a like view of a further embodiment of such a machine for work in switches, with a common drive means for both carrier frames.

FIG. 5 illustrates non-stop switch leveling, lining and tamping machine 99 comprising elongated heavy main frame 105 supported on two spaced apart swivel trucks 100, 101 for continuous movement along track 104 consisting of two rails 102 fastened to ties 103. Drive 106 operates on the wheels of rear swivel truck 100 to advance the heavy main frame continuously in an operating direction indicated by arrow 107. Operator's cabs 108, 109 are mounted on the heavy main frame at the respective ends thereof and operating control means 110 is mounted in rear cab 108. Schematically illustrated brake means 111 operating on the wheels of rear swivel truck 100 enables the machine to be stopped. Power plant 112 supplying energy to the drive means of the machine is mounted on the heavy main frame behind front cab 109. Leveling reference system 115 comprises tensioned reference wire 114 supported on rear track sensing element 113 and a front track sensing element while lining reference system 116 extends centrally between the track rails, all in a well known manner more particularly described hereinabove.

Carrier frame 118 is arranged between swivel trucks 100, 101 of heavy main frame 105 and has the form of a carriage with pole 119 projecting forwardly from the carriage in the operating direction. The pole is supported for universal movement in roller bearing 120 mounted on heavy main frame 105. Hydraulically operated cylinder-piston drive 121 links pole 119 to heavy frame 105 for universal movement of carrier frame 118 in relation to the heavy frame, the end of the piston rod of drive 121 being universally linked to the heavy frame. Illustrated drive 121 comprises a piston rod extending in the operating direction and longitudinally displaceably guiding and supporting carrier frame 118 on heavy frame 105 and a cylinder formed in pole 119 and slidable along the piston rod, carrier frame 118 being affixed to the cylinder. Since only the mass of the carrier frames needs to be intermittently accelerated and stopped while the heavy machine frame advances non-stop, the same amount of power applied by drive 121 for the intermittent displacement of the carrier frames will produce a faster movement and will, therefore, shorten the operating cycles.

Undercarriage 117 supports and guides the rear end of carrier frame 118 on the track, this undercarriage constituting a freely movable steering axle for the carrier frame and being equipped with its own drive 122 and brake 123. Vertically adjustable tamping means 124 is mounted on carrier frame 118 immediately in front of undercarriage 117 and is designed as a tamping unit for switch operation and mounted on a tamping tool carrier which is transversely adjustable on the carrier frame. Each tamping tool 125 is connected to an adjustment drive 126 for independently pivoting each tool laterally into and out of an operating position.

Sliding carriage 134 is longitudinally displaceably mounted on main frame 105 and track lifting and lining drive means 132, 133 links a rear end of carrier frame 128 for track lifting and lining means 127, in the operating direction, to sliding carriage 134. A front end of carrier frame 128 is linked to the front end of pole means 119 of carrier frame 118, and coupling means 136 interconnects sliding carriage 134 and carrier frame 128 to pole means 119 of carrier frame 118. In the illustrated embodiment, the front end of carrier frame 128 has guide rod 130 longitudinally adjustably linked to the front end of pole 119 of carrier frame 118. Clamping device 146 arranged on pivotal arm 147 affixed to the front end of pole 119 of carrier frame 118 enables guide rod 130 of carrier frame 128 to be detachably connected to the carrier frame pole so that the two carrier frames may be readily disconnected for repositioning. In this arrangement, the lifting and lining forces are transmitted primarily to the main frame of the machine despite the fact that the front ends of the carrier frames are linked thereto. Because the guide rod at the front of carrier frame 128 is longitudinally displaceable, the track lifting and lining means position may be longitudinally adjusted in relation to the tamping means before a tamping cycle so that the machine is readily adapted to prevailing operating conditions.

Illustrated carrier frame 128 also has the form of a carriage with a forwardly projecting pole, the carriage being supported on track 104 by two pairs of flanged wheels 129 and lifting hook 131 being mounted between the pairs of lining wheels 129 for engagement with a respective rail 102. Each lifting hook is adjustable transversely and vertically. Sliding carriage 134 transmits the lifting and lining forces from drives 132, 133 to heavy main frame 105, and is longitudinally displaceable along guide 135 affixed to the main frame and received in a guide slot in the sliding carriage. Coupling means 136 is shown as a mechanical double coupling between the sliding carriage and track lifting and lining means carrier frame 128. The coupling is comprised of a respective rod 137 connected, respectively, to sliding carriage 134 and carrier frame 128, the rods being laterally pivotal for adjustment and lateral freedom of movement between two bolts 138 affixed to pole 119 of carrier frame 118 and extending transversely to the longitudinal extension of the machine.

Track level errors are detected by track sensing element 139 arranged between tamping means 124 and track lifting and lining means carrier frame 128, the track sensing element being vertically adjustably mounted on carrier frame 118 for intermittent displacement with respect to the continuously advancing main frame, the intermittent advance of carrier frame 118 and 128 between tamping cycles being indicated schematically by short arrows 140. Minimal distance 141 between rear undercarriage 100 of main machine frame 105 and the support and guide undercarriage 117 of carrier frame 118 in its forward end position is about 2.5 m. In this end position, distance 142 between undercarriage 117 and front undercarriage 101 of the heavy main frame of machine 99 is about 9 m. Stops 143, 144 are affixed to heavy main frame 105 and are connected to operating control means 110 as well as drive 121 to synchronize the intermittent displacement of carrier frames 118, 128 while drive 106 advances the heavy main frame non-stop. All the operating drives on the carrier frames are connected by flexible connections 145 to control means 110 operated by operator 148 in cab 108.

Switch leveling, lining and tamping machine 99 is operated in the following manner:

At the beginning of the operation, drive 121 is actuated to displace coupled carrier frames 118 and 128 into the forward position centered over a tie 103 to be tamped. This displacement also entrains sliding carriage 134 coupled to the carrier frames. Tamping means 124 are then immersed into the ballast at the same time as drive 106 is actuated to advance heavy machine frame 105 non-stop in the operating direction. Carrier frames 118 and 128 remain stationary until the tamping and track correction cycle has been completed, during which cycle pole 119 of carrier frame 118 glides in roller bearing 120 and sliding carriage 134 glides along guide 135 from the front position shown in broken lines in FIG. 5 to a rear position shown in full lines in this figure. If the distance between carrier frames 118 and 128 is to be changed, pivotal coupling 146, 147 between the two carrier frames is moved out of engagement with guide rod 130 and carrier frame 128 is manually repositioned until the desired distance is obtained whereupon the coupling is restored for common intermittent displacement of the two carrier frames by drive 121. If desired, this repositioning may also be effected by actuating drive 121 while the two carrier frames are uncoupled until carrier frame 118 has been moved to a desired distance from carrier frame 128.

Figure 6:
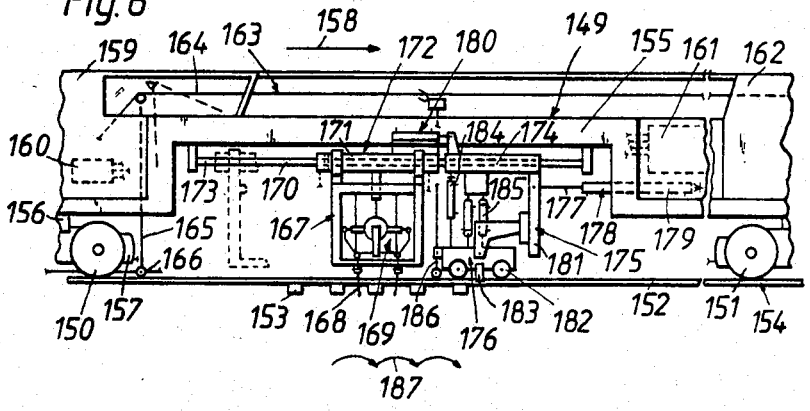
FIG. 6 is a like view of a switch tamper, with separate drive means for the carrier frames.

Non-stop switch leveling, lining and tamping machine 149 shown in FIG. 6 also comprises heavy main frame 155 supported on two spaced apart swivel trucks 150, 151 for continuous movement along track 154 consisting of rails 152 fastened to ties 153, in an operating direction indicated by arrow 158. Again, the rear swivel truck is equipped with drive 156 and brake 157 for advancing the main frame non-stop and for stopping the main frame. Operator's cab 159 housing operating control means 160 is mounted on the heavy main frame at the rear end thereof and is connected by flexible connections to the various operating drives, on the one hand, and power plant 161 supplying energy to the drives, on the other hand. Another operator's cab 162 is mounted on the heavy main frame at the front end thereof.

Tensioned reference wire 164 of track level reference system 163 is supported on rear track sensing element 165 vertically adjustably mounted on heavy main frame 165 while the front end of the system is supported on a forward track sensing element, as in the other embodiments. Also, track lining reference system 166 is arranged between track rails 152 for lining track 154. A respective carrier frame 167 for tamping means 169 comprising pairs of reciprocable vibratory tamping tools immersible in the ballast and independently laterally pivotal is associated with each track rail and is slidably supported on longitudinal guide 170 affixed to heavy main frame 155. Guide 170 is a piston rod 173 extending in the operating direction and longitudinally displaceably guiding and supporting carrier frame 167 on heavy frame 155 and cylinder 171 is slidable along the piston rod whereby the piston rod and cylinder constitute drive 172 for longitudinally displacing the carrier frame which is affixed to the cylinder. The piston rod constitutes a common guide longitudinally displaceably supporting not only carrier frame 167 but also carrier frame 175 which is affixed to sliding carriage 174 glidably supported on the common guide and supports track lifting and lining means 176 engaging both rails 152. Hydraulically operated cylinder-piston drive 178 connects carrier frame 175 to the main frame, piston rod 177 of drive 178 being pivotally connected to carrier frame 175 while cylinder 179 of the drive is universally linked to main frame 155. Coupling means 180 interconnect sliding carriage 174 of carrier frame 175 and sliding cylinder 171 of longitudinal displacement drive 172 of carrier frame 167. This coupling means consists of a hydraulically operated cylinder rigidly affixed to drive cylinder 171 while the piston rod gliding in the coupling cylinder is detachably connected to a bracket vertically upwardly projecting from sliding carriage 174. Carrier frame 175 comprises vertical arm 181 affixed to sliding carriage 174 and vertically adjustably carrying track lifting and lining means 176 which has two pairs of flanged lining wheels 182 and a vertically and laterally adjustable lifting hook 183 arranged between the lining wheels in association with each track rail. Lifting and lining drives 184, 185 link the track lifting and lining means to sliding carriage 174. Track level sensing element 185 of level reference system 163 is vertically adjustably mounted on carrier frame 175 in the illustrated embodiment although it could also be mounted on sliding carriage 174 or even on carrier frame 167. The wheel base between the inner axles of swivel trucks 150, 151 is about 10 to 11 m.

Non-stop operating machine 149 is operated in the following manner:

Drive 178 is actuated to bring carrier frames 167 and 175 into the forward position shown in full lines in FIG.

6 to center tamping means 169 over a tie 153 to be tamped. Before a tamping cycle is inititated, coupling 180 may be operated to adjust the distance between the two carrier frames, if desired. The hydraulically operated coupling is then blocked to keep the carrier frames at the adjusted distance. At the same time that the tamping cycle is initiated by immersing the tamping tools in the ballast and then operating the lifting and/or lining tools according to requirements, drive 156 is actuated to advance machine frame 155 non-stop. During this advancement, carrier frames 167 and 175 glide along common guide 170 into a rear position shown in broken lines, thus remaining stationary during the tamping cycle. At the end of the tamping cycle, drive 178 is actuated in the opposite direction to advance the carrier frames to their illustrated forward position centered over the next succeeding tie. When the piston rod of coupling 180 is detached from sliding carriage 174, the two carrier frames may be independently longitudinally displaced, carrier frame 167 being moved by drive 172 while drive 178 is actuated to move carrier frame 175.

What is claimed is:

1. A continuously advancing machine for leveling, lining and tamping a track consisting of two rails fastened to successive ties resting on ballast, which comprises (a) a heavy main frame supported on two spaced apart undercarriages for continuous movement in an operating direction, (b) a power plant, drive means and operating control means as well as an operator's cab for operating the drive and control means mounted on the main frame, (c) two separate carrier frames arranged between the two undercarriages of the heavy main frame, (d) another drive means connected to the heavy main frame for longitudinally displacing the carrier frames in relation to the main frame, the other drive means comprising a drive connecting one of the carrier frames to the mainframe, and the other carrier frame being longitudinally adjustably mounted on the main frame, (e) coupling means connecting the carrier frames for common and intermittent longitudinal displacement whereby the carrier frames may be intermittently advanced during the continuous movement of the heavy main frame, the drive having a displacement path corresponding to a distance between at least two successive ties, (f) tamping means mounted on the one separate carrier frame for tamping ballast in intermittent tamping cycles under respective ones of the ties at points of intersection of the two rails and the respective ties, (g) track lifting and lining means mounted on the other one of the separate carrier frames, (1) the tamping, lifting and lining means being arranged within sight of the operator's cab, and (2) the power plant delivering power to, and the operating control means controlling, the tamping, track lifting and lining means, and (h) track leveling and lining reference systems associated with the track lifting and lining means.

2. The track leveling, lining and tamping machine of claim 1, wherein each one of the carrier frames comprises a pair of flanged wheels at a rear end thereof, in the operating direction, each one of the pairs of flanged wheels supporting a respective one of the carrier frames on the track rails.

3. The track leveling, lining and tamping machine of claim 1, wherein the carrier frames are synchronously and together longitudinally displaceable by said other drive means.

4. The track leveling, lining and tamping machine of claim 3, wherein the drive is a common hydraulically operated cylinder-piston drive connecting the carrier frames to the main frame.

5. The track leveling, lining and tamping machine of claim 3, wherein said other drive means further comprises a separate hydraulically operated cylinder-piston drive connecting the other carrier frame to the main frame.

6. The track leveling, lining and tamping machine of claim 1, wherein the carrier frames are independently longitudinally displaceable by said other drive means.

7. The track leveling, lining and tamping machine of claim 1, wherein the coupling means is adjustable in the direction of the track.

8. The track leveling, lining and tamping machine of claim 1, wherein the one carrier frame has the form of a carriage with a pole means projecting forwardly from the carriage in the operating direction, the drive linking the pole means to the heavy frame for universal movement of the one carrier frame in relation to the heavy frame, and further comprising a pair of flanged wheels at a rear end of the carriage, in the operating direction, for supporting and guiding the carriage on the track rails, the tamping means being mounted on the carriage immediately adjacent the pair of flanged wheels forwardly thereof, in the operating direction, track lifting drive means for vertically adjusting the other carrier frame in relation to the main frame and the one carrier frame, and at least one pair of flanged wheels guiding and supporting the other carrier frame on the track rails.

9. The track leveling, lining and tamping machine of claim 8, further comprising means for transversely displacing the tamping heads, and the other carrier frame being a common frame whereon the track lifting and lining means associated with both track rails are mounted, the other drive means comprising another drive linking the common frame to the main frame.

10. The track leveling, lining and tamping machine of claim 8, further comprising a sliding carriage longitudinally displaceably mounted in a longitudinal guide bearing on the main frame, the track lifting drive means linking the other carrier frame to the sliding carriage, and the other drive means comprising another drive connected to the sliding carriage.

11. The track leveling, lining and tamping machine of claim 10, wherein the other drive is a hydraulically operated cylinder-piston drive, the cylinder of the drive being linked to the main frame and the piston thereof being linked to the sliding carriage.

12. The track leveling, lining and tamping machine of claim 1, wherein the one carrier frame has the form of a carriage with a pole means projecting forwardly from the carriage in the operating direction, the drive is a hydraulically operated cylinder-piston drive linking the pole means to the heavy frame for universal movement of the one carrier frame in relation to the heavy frame, further comprising a freely movable steering gear supporting a rear end of the carriage, in the operating direction, on the track rails, and wherein the other carrier frame also has the form of a carriage with a pole means projecting forwardly from the carriage in the operating direction, the pole means of the other carrier frame being linked to the heavy frame for universal movement in relation thereto, further comprising track lifting drive means linking a rear end of the carriage of the other carrier frame to the carriage of the one carrier frame, and the coupling means interconnects the pole means of the carrier frames at front ends thereof, in the operating direction.

13. The track leveling, lining and tamping machine of claim 1, wherein the one carrier frame has the form of a carriage with a pole means projecting forwardly from the carriage in the operating direction, the drive is hydraulically operated cylinder-piston drive linking the pole means to the heavy frame for universal movement of the one carrier frame in relation to the heavy frame, further comprising a sliding carriage longitudinally displaceably mounted on the main frame, track lifting drive means linking a rear end of the other carrier frame, in the operating direction, to the sliding carriage, a front end of the other carrier frame being linked to a front end of the pole means of the one carrier frame, and the coupling means interconnects the sliding carriage and the other carrier frame to the pole means of the one carrier frame.

14. The track leveling, lining and tamping machine of claim 13, wherein the front end of the other carrier frame has a guide rod longitudinally adjustably linked to the front end of the pole means of the one carrier frame.

15. The track leveling, lining and tamping machine of claim 1, wherein the other drive means comprises a piston rod extending in the operating direction and longitudinally displaceably guiding and supporting the one carrier frame on the heavy frame and a cylinder slidable along the piston rod, the one carrier frame being affixed to the cylinder.

16. The track leveling, lining and tamping machine of claim 15, wherein the piston rod constitutes a common guide longitudinally displaceably supporting the carrier frames, further, comprising a sliding carriage glidably supported on the common guide rod and forming an upper portion of the other carrier frame, and wherein the other drive means comprises another hydraulically operated cylinder-piston drive connecting the other carrier frame to the main frame.

17. The track leveling, lining and tamping machine of claim 1, wherein the tamping means comprises a tamping head associated with each one of the track rails, each tamping head comprising a vertically adjustable tamping tool carrier and pairs of power-driven, reciprocable and vibratory tamping tools mounted on the tamping tool carrier, and the track lifting and lining means comprises a track lifting and lining unit preceding the tamping means, in the operating direction, the track lifting and lining unit comprising track lifting and lining tools arranged for engagement with the track rails and drives for vertically and laterally moving the tools for track leveling and lining.

18. The track leveling, lining and tamping machine of claim 1, further comprising an undercarriage supporting and guiding the one carrier frame on the track rails, and drive and brake means for independently driving and stopping the undercarriage.

19. The track leveling, lining and tamping machine of claim 18, wherein the distance between the undercarriage and the track lifting and lining means spans about five to six successive ties.

20. The track leveling, lining and tamping machine of claim 1, wherein the one carrier frame is an elongated subframe having a front and a rear end, in the operating direction, further comprising an undercarriage supporting and guiding the rear end of the subframe on the track rails and another undercarriage at the front end of the subframe, and the drive is a hydraulically operable, longitudinally adjustable cylinder-piston coupling linking the one carrier frame to the main frame for longitudinally displacing the one carrier frame in relation to the main frame.

21. The track leveling, lining and tamping machine of claim 1, wherein the drive is a double-acting, hydraulically operable cylinder-piston drive and further comprising valve means controlling the piston movement of the drive for displacing the carrier frames synchronously with the advancing movement of the heavy frame but in an opposite direction thereto.

* * * * *